US006432598B1

(12) United States Patent
Alexandrovich et al.

(10) Patent No.: US 6,432,598 B1
(45) Date of Patent: Aug. 13, 2002

(54) PROCESS FOR FORMING TONERS CONTAINING ISOINDOLINE YELLOW PIGMENT

(75) Inventors: Peter S. Alexandrovich, Rochester; Mark J. Stachowski; Dinesh Tyagi, both of Fairport, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/892,946

(22) Filed: Jun. 27, 2001

(51) Int. Cl.[7] ..... G03G 9/09

(52) U.S. Cl. ..... 430/107.1; 430/137.18; 430/137.1

(58) Field of Search ..... 430/107.1, 108.21, 430/137.18, 137.1, 45

(56) References Cited

U.S. PATENT DOCUMENTS

| | | | | |
|---|---|---|---|---|
| 4,759,801 A | | 7/1988 | Goldmann et al. | 106/502 |
| 5,554,471 A | | 9/1996 | Bertrand et al. | 430/45 |
| 5,607,804 A | | 3/1997 | Bertrand et al. | 430/106 |
| 5,620,820 A | | 4/1997 | Bertrand et al. | 430/42 |
| 6,100,000 A | * | 8/2000 | Anno et al. | 430/110.4 |
| 6,106,986 A | * | 8/2000 | Shirai et al. | 430/109.4 |

OTHER PUBLICATIONS

BASF Technical Information Sheet for Lupreton Preparations, pp. 1–2, (May 1999).
BASF Product Data Safety Sheet for Paliotol Yellow D1819, pp. 1–2, (Jun. 2000).
Kao Corporation Product Information Sheet for Kao Toner Binder Resin, pp. 1–3, (Apr. 2001).
D.E. Bisset, et al.,*The Printing Ink Manual*, Third Edition, Northwood Publications, London, pp. 313, (1979).

* cited by examiner

*Primary Examiner*—John L Goodrow

(57) ABSTRACT

A process for forming a particulate yellow toner for the development of latent electrostatographic latent images comprises: combining dry Pigment Yellow 185 (P.Y. 185) and a first thermoplastic polymer under conditions effective to form a predispersion of P.Y. 185 in the polymer, and combining the predispersion with a second thermoplastic polymer under conditions effective to form a yellow toner composition, from which is formed yellow toner particles.

35 Claims, 4 Drawing Sheets

Comparative Example 1

Comparative Example 1

P.Y. 185 at 4 pph Concentration

PROCESS FOR FORMING TONERS CONTAINING ISOINDOLINE YELLOW PIGMENT

FIELD OF THE INVENTION

The present invention relates to electrostatographic toners and, more particularly, to a process for forming yellow toners using the dry aggregated state of an isoindoline yellow pigment.

BACKGROUND OF THE INVENTION

Pigment concentrates, or pigment predispersions, are used to prepare toners employed in full color electrostatographic processes. Melt blending of dry pigment materials with other toner ingredients such as binder resins, charge agents, wax additives and the like, generally using a roll mill or an extruder, typically results in a nonuniform dispersion of the pigment in the melt. Subsequent cooling and pulverization of the melt produces a toner having poor color quality and low tinctorial strength. Uniform dispersion of a colorant or pigment in a color toner is necessary for realizing the highest possible color gamut, minimizing the amount of toner laid down on a page, achieving reproducibility of color and electrostatic and physical properties, and optimizing the cost of toner preparation.

In order to overcome the aforementioned dispersion difficulties, it is common practice in the prior art to prepare a pigment concentrate or predispersion by a technique known as "flushing," which entails using a vehicle that is compatible with the final toner binder resin to remove water from a damp pigment press cake. The flushed pigment concentrate is then added to the melt blending step of the toner manufacturing process, resulting in a relatively good dispersion of the pigment.

The flushing process and its advantages as applicable to printing inks are described in *The Printing Ink Manual*, Third Edition, D. E. Bisset, C. Goodacre, H. A. Idle, R. H Leach and C. H. Williams, editors, Northwood Publications Ltd, London, 1979, page 313:

"Flushing is defined as the operation in which the water phase of an aqueous pigment press cake is removed and replaced by an oil or resin phase, such as an ink vehicle, in one operation. This avoids the normal operations of drying, crushing and powdering the pigment, and redispersing in a selected ink vehicle. The flushing process starts with the pigment in press cake form; therefore the pigment particles have not been subjected to a heat-assisted drying process which can lead to the formation of hard aggregates. Thus, the degree of dispersion of flushing is usually very good, but the process is suited only to production of large batches for reasons of cost. Advantages claimed for the flushing process are that some pigments, such as diarylide yellows, are heat sensitive and flushing overcomes the difficulties that occur when drying these pigments normally. Claimed advantages include greater transparency, better gloss and higher tinctorial strength of flushed colors."

U.S. Pat. No. 4,759,801, the disclosure of which is incorporated herein by reference, describes a kneading or flushing process starting with a wet pigment press cake that is asserted to have advantages of energy savings, lower temperatures enabling the use of heat sensitive pigments, higher concentration preparations, and high color yield and purity compared to previously known methods in which finely-ground dry pigment is mixed with thermoplastic material, i.e. synthetic waxes or synthetic resins, at extrusion temperatures of up to 300° C.

The diarylide family of yellow pigments as a class has found wide application in process color printing inks, members of which have also found use in electrostatographic toner based applications for process color copying and printing. However, this class of pigments is synthesized from a toxic intermediate known as dichlorobenzidine, which itself can be generated by thermally decomposing such pigments. Modern industrial practice is to avoid using such materials if at all possible.

Thus, there has been a need to find high strength alternatives to diarylide yellow colorants for use in electrostatographic full process color printing processes that employ a toner set comprising a cyan, a magenta, a yellow and, optionally, a black toner. One such alternative is the isoindoline yellow pigment known by its Color Index designation as Pigment Yellow 185, or P.Y. 185. As stated in *Industrial Organic Pigments*, W. Herbst and K. Hunger, VCH Verlagsgellschaft Weinheim, Germany, 1993, at page 412: "P.Y.185, a comparatively recent product, is an isoindoline pigment and provides clean greenish shades of yellow. Its main field of application is in packaging printing inks. P.Y. 185 confers good tinctorial strength and high gloss on prints made from NC-based inks. Its tinctorial strength in print exceeds that of P.Y.17, a pigment of the diarylide yellow pigment series, which provides the same hue."

Flushed isoindoline yellow pigment concentrates, including P.Y.185, have been used, along with other flushed pigment concentrates to prepare cyan, magenta, yellow and black process color toner sets, as described in U.S. Pat. Nos. 5,554,471, 5,607,804 and 5,620,820, the disclosures of which are incorporated herein by reference.

SUMMARY OF THE INVENTION

The present invention is directed to a process for forming a particulate yellow toner for the development of latent electrostatographic latent images. The process comprises: combining dry Pigment Yellow 185 (P.Y.185) and a first thermoplastic polymer under conditions effective to form a predispersion of P.Y.185 in the polymer, and combining the predispersion with a second thermoplastic polymer under conditions effective to form a yellow toner composition, from which is formed yellow toner particles.

DETAILED DESCRIPTION OF THE INVENTION

Figure 1:
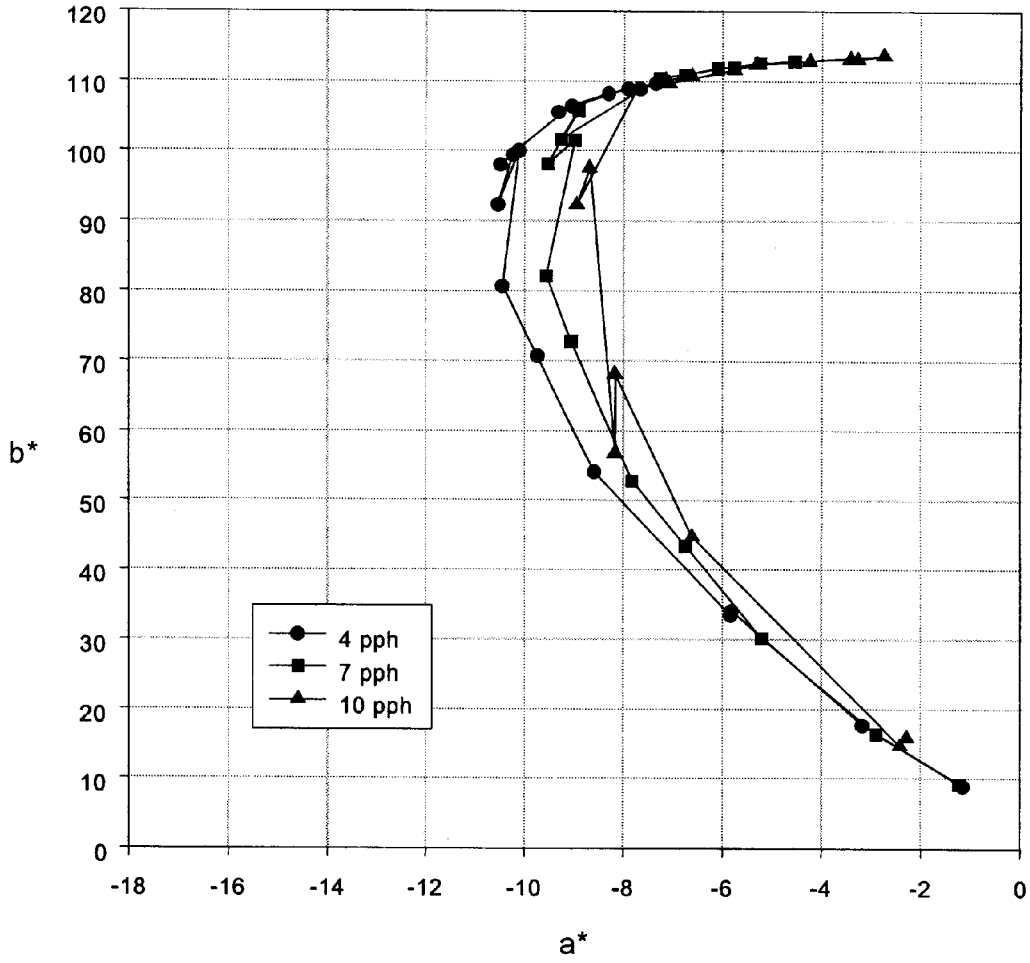
FIG. 1 depicts a series of b* vs a* plots measured for toners of Comparative Example 1.

The isoindoline yellow pigment P.Y.185 is available in the aggregated dry pigment state as PALIOTOL® Yellow D1155 from BASF Aktiengesellschaft, Ludwigshafen, Germany. LUPRETON® Yellow SE1161, a flushing process pigment concentrate of P.Y.185 produced by process involving displacing the water from a wet pigment press cake by the organic polymer matrix, is marketed specifically for use in toner applications by BASF Aktiengesellschaft.

We have unexpectedly found that predispersions, or concentrates, of isoindoline Yellow Pigment 185 (P.Y.185)

can be prepared from aggregated dry P.Y.185 that are superior in color purity and tinctorial strength to concentrates prepared by the flushing process. Predispersions prepared in accordance with the present invention can then be used to prepare yellow toners that are useful for full color electrostatographic printing processes and are superior in color purity, less expensive to manufacture, and require the use of less toner on the printed page. Yellow toners prepared from P.Y.185 in accordance with the invention can produce a color gamut greater than is achievable with diarylide yellow pigments, thus enabling a wide gamut full color printing process free of the environmental concerns associated with diarylide yellow pigments.

In the process for forming a particulate yellow toner in accordance with the present invention, dry Pigment Yellow 185 (P.Y.185) and a first thermoplastic polymer are combined under conditions effective to form a predispersion of P.Y.185 in polymer, and the resulting predispersion is combined with a second thermoplastic polymer under conditions effective to form a yellow toner composition. Each of the combining steps can be carried out using an extruder, a roll mill, or a kneading mill such as a Z-arm mixer at a selected temperature, preferably, about 80° C. to about 160° C., more preferably, about 120° C.

The first and second thermoplastic polymers, which can be the same or different from one another, are each individually selected from the group consisting of polyesters, polyamides, polyolefins, acrylic polymers and copolymers, methacrylic polymers and copolymers, styrenic polymers and copolymers, vinyl polymers and copolymers, and polyurethanes. Preferably, the first and second thermoplastic polymers are each polyesters.

In accordance with the invention, the predispersion comprises, preferably, about 20 to about 60 weight percent of P.Y.185 and about 80 to about 40 weight percent of the first thermoplastic polymer, more preferably, about 40 weight percent of P.Y.185 and about 60 weight percent of the first thermoplastic polymer.

Further in accordance with the invention, the yellow toner composition comprises, preferably, about 2 to about 30 weight percent of P.Y.185 and about 98 to about 70 weight percent of combined first and second thermoplastic polymers, more preferably, about 3 to about 20 weight percent of P.Y.185 and about 97 to about 80 weight percent of combined first and second polymers, most preferably, about 3 to about 10 weight percent of P.Y.185 and about 97 to about 90 weight percent of the combined polymers. The yellow toner composition can further include a charge agent, which is combined with the predispersion and the second thermoplastic polymer.

Yellow toner particles can be prepared from the yellow toner composition using, for example, a jet mill pulverizer. The resulting toner particles have a volume median particle size, preferably, of about 4 microns to about 25 microns, more preferably, about 5 microns to about 12 microns, most preferably, about 6 microns to about 8 microns.

The yellow toner particles formed by the process of the present invention are useful for the development of latent electrostatographic latent images and can be advantageously employed in combination with magenta, cyan, and, optionally, black toner particles in a full color electrostatographic process. The yellow toner particles can further be combined with toners of other colors, for example, orange, green, or purple, in pentachrome (five-color) or hexachrome (six-color) processes.

COMPARATIVE EXAMPLE 1

Isoindoline yellow toners were prepared by melt blending on a two roll mill FINETONE® 382ES, a propoxylated bisphenol A—fumaric/maleic acid based polyester, marketed as a toner binder resin by Reichold Chemicals, Research Triangle Park, NC, and LUPRETON® Yellow SE1161, containing 40% P.Y.185 in a polyester resin of similar chemical and physical constitution as the bulk toner resin. The melts were prepared at pigment concentrations of 4, 7 and 10 pph (parts pigment per hundred parts resin), corresponding to concentrations by weight of 3.85%, 6.54% and 9.09%. Toners of approximately 8 microns volume median particle size, as measured on a Coulter Multisizer device, were prepared from the cooled melts using a Trost TX jet mill pulverizer The tinctorial strength of the toners was evaluated as a "covering power" value. A series of patches of varying density of toner was prepared on clear film; the weight of toner in each patch and area of each patch was measured. The patches were then fused in an oven controlled at a temperature hot enough such that a continuous thin film of toner resulted. The transmission densities of the resulting patches were measured with a Status A blue filter on an X-Rite densitometer. A straight line was drawn through the data for each toner, and the weight per unit area of toner was then calculated at a transmission density of 1.0. The reciprocal of this value, in units of square centimeters per gram, is defined as the covering power (the area covered to a transmission density of 1.0 by one gram of toner). As the covering power increases, the "yield" of the toner increases, that is, less mass is need to create the same amount of density*area coverage in a print. The covering power values of the Comparative Example 1 toners based on a flushed P.Y.185 concentrate are listed in TABLE I.

The calorimetric properties of the toners of Comparative Example 1 were evaluated using a series of density patches prepared on a 118 g basis weight, coated graphic arts paper stock, LUSTRO LASER®, from the S. D. Warren company. The patches were fused in a roller fusing apparatus comprising an internally heated, fluoroelastomer coated fusing roller, and a hard, Teflon coated pressure roller. The fusing conditions were adjusted such that the highest density patches had a G60 Gardiner gloss value of from about 30 to 50. CIELAB L*, a* and b* values were obtained from the fused patches with a Gretag Model SPM-100 calorimeter, and are shown in FIG. 1 as a plot of b* vs a*, referred to as the "build curve" for the toner. Referring to the build curve, as the patch density increases, the distance from the origin, or "chroma" increases. As the patch density increases, the lightness values L* (not shown here) decrease. It can be seen in FIG. 1 that, as the concentration of P.Y.185 in the toner is increased, the build curves shift to a redder color, as indicated by the higher, i.e., less negative, a* values. It is possible to obtain a higher yield toner by increasing the concentration of P.Y.185 in the toner but at the expense of a less desirable redder hue.

Figure 2:
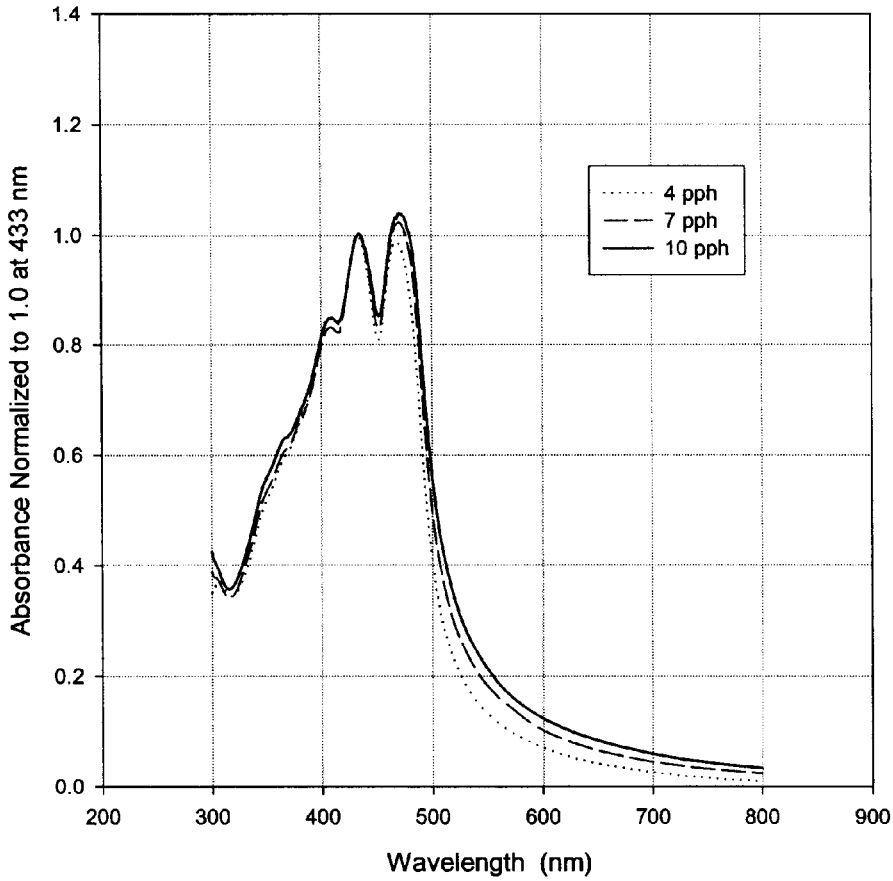
FIG. 2 contains a series of absorbance spectra of yellow pigment colloidal suspensions from Comparative Example 1.

The spectral absorbance properties of the toners of Comparative Example 1 were evaluated by dissolving the toners in dichloromethane at a concentration of approximately 50 mg toner per 100 mL of solution, and measuring absorbance versus wavelength with a Perkin-Elmer model Lambda 2S spectrophotometer. The toner resin is soluble in dichloromethane, but the isoindoline yellow pigment is not, instead becoming dispersed as a colloid that is stable to settling for a period of weeks. The absorbance spectra for the Comparative Example 1 toners are shown in FIG. 2, where the values have been normalized to 1.0 at the 433 nm peak in the absorbance curve. The values of absorbance at each wavelength for each toner were divided by the value at 433 nm for that toner. It is seen that there is a shift in the curve shapes of the absorbance spectra as the pigment concentration in the toner is increased. At wavelengths in the "green" region, centered at about 550 nm, there is an increasing absorption of light as the P.Y.185 concentration is increased in the toner relative to the absorption of light in the peak absorption region of 433 nm.

This is the range of wavelengths where the magenta toner in the full color printing process absorbs most strongly. The combination of the subtractive primary colors yellow plus magenta produces the color red. Thus this increased absorbance in the green wavelength region associated with increased pigment concentration is responsible for the shift to redder hues seen in the actual colorimetric data for the toner on paper shown in FIG. 1. The ratio of absorbance values at 433 nm to those at 550 nm is listed in TABLE I. Since it is undesirable for a yellow toner to absorb at wavelengths where the magenta toner should, this ratio should be as high as possible to ensure high color purity.

TABLE I

| Comparative Example | pph of P.Y. 185 Added via Flushed Concentrate | Covering Power in $cm^2/g$ (tinctorial strength) | Absorbance Values Ratio A433 nm/A550 nm |
|---|---|---|---|
| 1A | 4 | 1660 | 7.6 |
| 1B | 7 | 2740 | 5.5 |
| 1C | 10 | 3220 | 4.7 |

COMPARATIVE EXAMPLE 2

Isoindoline yellow toners were prepared by melt blending on a two roll-mill KAO Binder C, a propoxylated bisphenol A—fumaric acid based polyester from Kao Corporation, Tokyo, Japan, PALIOTOL® Yellow D1155, a dry pigment form of P.Y.185 from BASF Aktiengesellschaft, and a charge agent, BONTRON® E-84, from Orient Corporation of America, Kenilworth N.J. The melts were prepared at pigment concentrations of 4, 7 and 10 pph (parts pigment per hundred parts resin), corresponding to concentrations by weight of 3.77%, 6.42% and 8.93%, as Comparative Examples 2A, 2B and 2C, respectively. Toners of approximately 8 microns volume median particle size, as measured on a Coulter Multisizer device, were prepared from the cooled melts on a Trost TX jet mill pulverizer. Covering power values were measured as previously described and listed in TABLE II.

It can be seen from a comparison of the data in TABLES II and I that the resulting toner tinctorial strength from the toners prepared from the dry pigment is much lower than is observed with the toners prepared by the addition of P.Y.185 in flushed form.

Absorbance spectra were measured as previously described, and the ratio of desired absorbance at 433 nm to unwanted absorbance at 550 nm was calculated, the results also being included in TABLE II. It is seen the values for the dry pigment addition method are undesirably lower than those for the flushed concentrate method presented in TABLE I. CIELAB colorimetric values were measured as described previously, and were found to demonstrate redder color than the comparative example I toners of FIG. 1. The dispersion of pigment in the Comparative Examples 1 and 2 toners was qualitatively evaluated with an optical microscope on melt smears prepared on glass slides with an optical microscope. The dispersion quality of the Comparative Example 2 toners was judged to be worse than that for the Comparative Example 1 toners. It is concluded that indeed, as described in prior art such as the previously discussed U.S. Pat. Nos. 5,554,471, 5,607,804, and 5,620,820, the dispersion quality and resulting toner color quality are superior for P.Y.185 containing toners prepared via a flushed pigment concentrate relative to those obtained by dry pigment addition.

TABLE II

| Comparative Example | pph of P.Y. 185 Direct Addition of Dry Pigment | Covering Power in $cm^2/g$ (tinctorial strength) | Absorbance Values Ratio A433 nm/A550 nm |
|---|---|---|---|
| 2A | 4 | 870 | 4.4 |
| 2B | 7 | 1690 | 4.8 |
| 2C | 10 | 2470 | 2.2 |

INVENTIVE EXAMPLE 1

Predispersions or master batches of P.Y.185, starting from PALIOTOL® Yellow D1155 dry pigment, were prepared in the following way: At a compounding temperature of 120° C., 40% by weight of the dry P.Y.185 pigment was mixed with 60% by weight of three different polyester resins on a two-roll melt compounding mill for 20 minutes at 120° C. The polyester resins used in these concentrates covered a range of melt viscosities; it is postulated that the higher the melt viscosity of the resin, the more the amount of shear energy expended in dispersing the pigment. In accordance with the invention, the binder polymers have viscosities at 120° C. at I rad/sec of, preferably, about 0.5–200 kilopoise, more preferably, about 2–80 kilopoise, most preferably, about 1.5–10 kilopoise.

The resins used in the predispersions in order of increasing viscosity were KAO Binders C, N, and G, all obtained from Kao Corporation, Tokyo, Japan. The melt viscosity values for these resins listed in TABLE III were measured on a Rheometrics model RDA-700 melt rheometer at 120° C. at 1 rad/sec in units of kilopoise (kP). Toners were then prepared by diluting these 40% predispersions to 4 pph (3.77% by weight) pigment in the low viscosity toner resin, KAO Binder C, along with 2 pph of the charge agent BONTRON® E-84, mixing being carried out for 15 minutes at 120° C. on the two-roll mill. The solidified melts were then ground to approximately 8 microns particle size using a jet mill pulverizer to produce toner Examples 1A, 1B, and 1C of the present invention. Covering power and absorbance values ratios were obtained as previously described for these toners and are presented in TABLE III below.

TABLE III

| Inventive Example | Pre-dispersion Resin | Melt Viscosity of Predispersion Resin | Covering Power in $cm^2/g$ (tinctorial strength) | Absorbance Values Ratio A433 nm/A550 nm |
|---|---|---|---|---|
| 1A | Binder C | 2.2 kP | 2210 | 22.8 |
| 1B | Binder N | 51. kP | 2460 | 29.7 |
| 1C | Binder G | 76. kP | 2620 | 33.8 |

Compared with those in toners made from flushed predispersions, as described in Comparative Example 1, or prepared by direct dry pigment addition, as described in Comparative Example 2, superior pigment dispersions resulted in all three examples prepared in accordance with the present invention. The covering power and the absorbance values ratio of Inventive Examples 1A, 1B, and 1C, each containing 4 pph P.Y.185, were all superior to those Comparative Examples 1A and 2A having the same pigment concentration.

Figure 3:
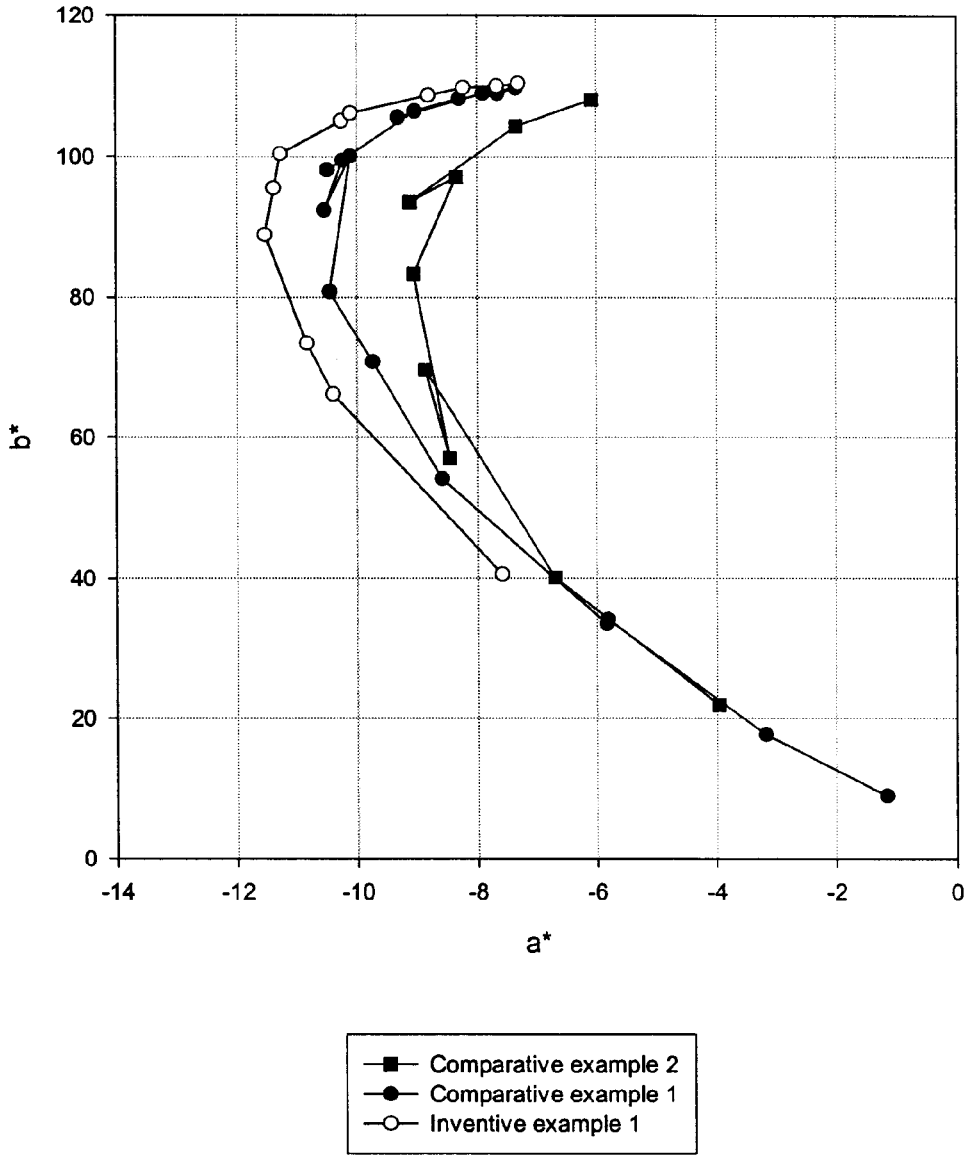
FIG. 3 contains a series of b* vs a* plots of comparative and inventive toners.

The colorimetric properties of toner prepared by the dry predispersion method of Inventive Example 1C are contrasted with those of toners made by direct dry pigment addition (Comparative Example 2) and the flush predispersion method (Comparative Example 1) in FIG. 3, which shows build curves for fused patches of toner on paper, prepared as described previously. All the toners included in FIG. 3 have the same concentration of P.Y.185: 4 pph or 4 parts pigment per 100 parts total resin. The Inventive Example 1C toner is seen to have a greener shade (shifted leftward, more negative a* values; the comparative examples have a redder shade) and to be of higher chroma (farther away from the 0, 0 a*, b* origin).

Pigment Red 57:1 and Pigment Blue 15:3 are widely used colorants in the printing ink industry for magenta and cyan inks and toners. Flush process magenta and cyan pigment concentrates employing P.R. 57:1 and P.B. 15:3, designated LUPRETON® Red SE 1255 and LUPRETON® Blue SE 1163, respectively, and dry pigment forms of P.R. 57:1 and P.B. 15:3, designated Lithol Rubine D 4656DD and Heliogen Blue K 7090, respectively, were obtained from BASF Aktiengesellschaft . Magenta and cyan toners, each having a pigment concentration of 4 pph, were prepared from flush concentrates LUPRETON® Red SE 1255 and LUPRETON® Blue SE 1163, respectively, by the same procedure as was used in Comparative Example 1. Magenta and cyan toners, each having a pigment concentration of 4 pph, were prepared from dry pigments Lithol Rubine D 4656DD and Heliogen Blue K 7090, respectively, by the same direct addition procedure employed in Comparative Example 2 as well as by the same melt compounding predispersion technique, and using the same predispersion resins, as in Inventive Examples 1A, 1B and 1C. The covering power of the resulting magenta and cyan toners were measured using Status A green and red filters, respectively. By contrast with the results obtained with the yellow toners containing P.Y. 185, the magenta and cyan toners exhibiting the highest covering power or tinctorial strength were not those prepared from the dry pigments by the melt compounding predispersion method of Inventive Example 1 but rather those from the flush concentrates according to the procedure of Comparative Example 1. These results observed with toners containing magenta and cyan pigments confirm the unexpectedness of the results obtained with toners of the present invention formed from dry Pigment Yellow 185.

INVENTIVE EXAMPLE 2

LUPRETON® Yellow SE 1753 and LUPRETON® Yellow SE 1792, predispersions or master batches of P.Y.185 prepared from the aggregated dry pigment state rather than by flushing of an aqueous pigment press cake, were obtained from BASF Aktiengesellschaft, Ludwigshafen, Germany. LUPRETON® Yellow SE 1753 was stated to have been prepared in a kneading/blade type melt mixing device, and LUPRETON® Yellow SE 1792 was stated to have been prepared in an extruder. Toners were prepared by mixing these concentrates with Binder C resin and E-84 charge agent on a two-roll mill, with the final pigment concentration being 4 parts by weight P.Y.185 to 100 parts by weight total resin. Inventive Example 2A was prepared from LUPRETON® Yellow SE 1753, Inventive Example 2B from LUPRETON® Yellow SE 1792. Toner particles of approximately 8 microns diameter were prepared using a jet mill pulverizer, as described previously. TABLE IV summarizes results with these toners. Both the covering power and the absorbance values ratios for Inventive Examples 2A and 2B are higher than those of Comparative Example 1A, prepared by the flushed predispersion method and containing 4 pph P.Y.185, or Comparative Example 2A, prepared by the direct dry pigment addition method and also containing 4 pph P.Y. 185.

TABLE IV

| Inventive Example | Dry Process Predispersion | Covering Power in $cm^2/g$ (tinctorial strength) | Absorbance Values Ratio A433 nm/A550 nm |
|---|---|---|---|
| 2A | LUPRETON ® SE1753 | 1900 | 13.2 |
| 2B | LUPRETON ® SE1792 | 1900 | 13.8 |

COMPARATIVE EXAMPLE 3

Figure 4:
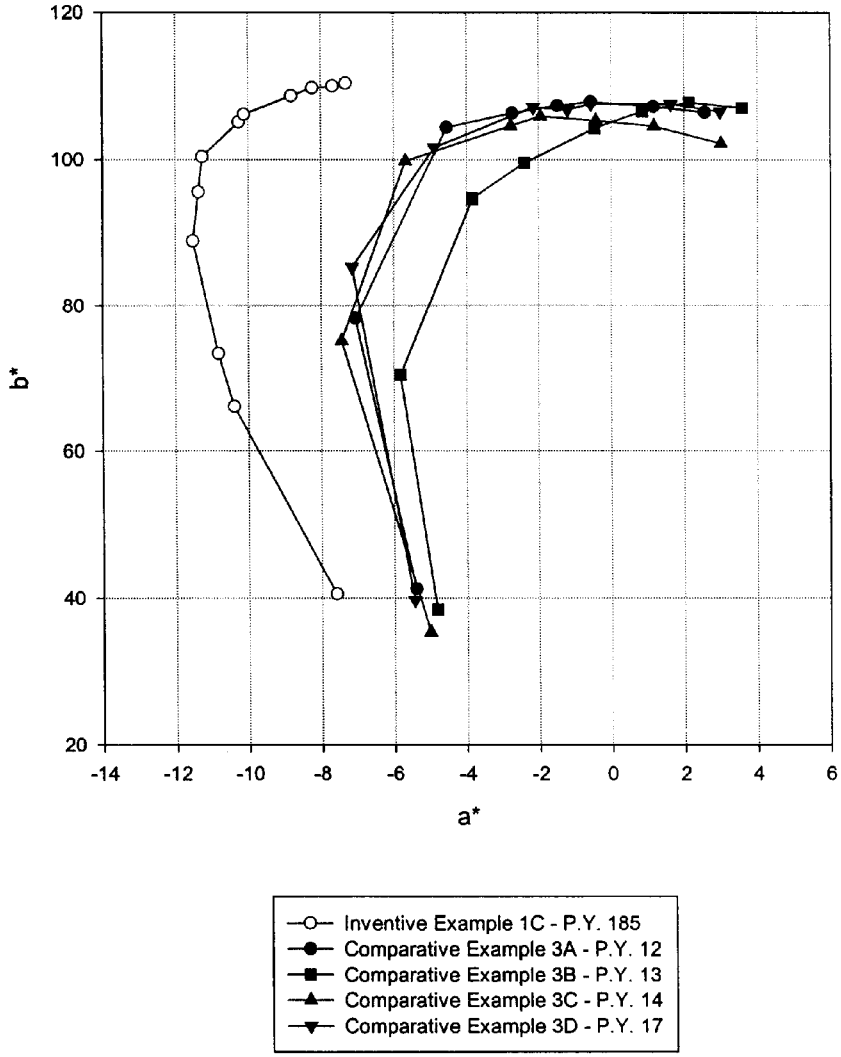
FIG. 4 contains a series of b* vs a* plots comparing toners containing isoindoline and diarylide yellow pigments.

Yellow pigments of the diarylide class have been widely used in the ink industry as the colorant for process yellow printing ink. Toners were prepared from four examples of diarylide yellow pigments, using the dry process predispersion method of Inventive Example 1. Permanent Yellow DHG 11-1003, P.Y. 12 (Comparative Example 3A), and Permanent Yellow G 1-1101, P.Y. 14 (Comparative Example 3C), were obtained as dry pigments from the Clariant Corporation of Coventry, RI, and Sico Fast Yellow NBD 1362, P.Y. 13 (Comparative Example 3B), and Sico Fast Yellow NBD 1256, P.Y. 17 (Comparative Example 3D), were obtained, also as dry pigments, from BASF Aktiengesellschaft. Predispersions containing 40% by weight pigment and 60% by weight Binder N resin from Kao Corporation were made by mixing for 20 minutes at 120° C. on a two roll mill. Toners were prepared from these concentrates by mixing with 2 pph of charge agent BONTRON® E-84 and Binder C resin from Kao Corporation. The final pigment concentration was 4 parts pigment based on 100 parts total resin. Fused patches of toner on paper were prepared, and CIELAB measurements of a* and b* were made as described earlier. The results are shown, along with Inventive Example 1C, in FIG. 4. It can be seen that the Inventive Example 1C toner is of a greener shade (more negative a* values) than the Comparative Example 3 toners, and is of greater chroma (the square root of the sum of the squares of a* and b*), i.e., further away from the 0, 0 a*, b* origin. The maximum chroma attained by Inventive Example 1C was 110.6, while that for Comparative Examples 3A, 3B, 3C, and 3D was 107.9,107.8,105.9 and 107.6, respectively. It is thus expected that Pigment Yellow 185 based toners prepared using the present inventive dry process predispersion method can, when combined with appropriate cyan and magenta toners, provide a greater total gamut of colors in printing than can toners based on the diarylide yellow colorants Pigment Yellow 12, Pigment Yellow 13, Pigment Yellow 14, and Pigment Yellow 17.

The invention has been described in detail with particular reference to certain preferred embodiments thereof, but it is understood that variations and modifications can be effected within the spirit and scope of the invention, which is defined by the following claims.

What is claimed is:

1. A process for forming a particulate yellow toner for the development of latent electrostatographic latent images, said process comprising:

combining dry Pigment Yellow 185 (P.Y.185) and a first thermoplastic polymer under conditions effective to form a predispersion of said P.Y.185 in said polymer;

combining said predispersion with a second thermoplastic polymer under conditions effective to form a yellow toner composition; and forming yellow toner particles from said yellow toner composition.

2. The process of claim 1 wherein each said combining is carried out using an extruder, a roll mill or a kneading mill at a selected temperature.

3. The process of claim 2 wherein said selected temperature is from about 80° C. to about 160° C.

4. The process of claim 3 wherein said selected temperature is about 120° C.

5. The process of claim 1 wherein said first and second thermoplastic polymers are each individually selected from the group consisting of polyesters, polyamides, polyolefins, acrylic polymers and copolymers, methacrylic polymers and copolymers, styrenic polymers and copolymers, vinyl polymers and copolymers, and polyurethanes.

6. The process of claim 5 wherein said first and second thermoplastic polymers are each polyesters.

7. The process of claim 5 wherein said first and second thermoplastic polymers are the same.

8. The process of claim 1 wherein said predispersion comprises about 20 to about 60 weight percent of said P.Y. 185 and about 80 to about 40 weight percent of said first thermoplastic polymer.

9. The process of claim 8 wherein said predispersion comprises about 40 weight percent of said P.Y. 185 and about 60 weight percent of said first thermoplastic polymer.

10. The process of claim 1 wherein said yellow toner composition comprises about 2 to about 30 weight percent of said P.Y. 185 and about 98 to about 70 weight percent of combined said first and second thermoplastic polymers.

11. The process of claim 10 wherein said yellow toner composition comprises about 3 to about 20 weight percent of said P.Y. 185 and about 97 to about 80 weight percent of combined said first and second thermoplastic polymers.

12. The process of claim 11 wherein said yellow toner composition comprises about 3 to about 10 weight percent of said P.Y. 185 and about 97 to about 90 weight percent of combined said first and second thermoplastic polymers.

13. The process of claim 1 wherein said first and second thermoplastic polymers each has a viscosity, measured at 120° C. at 1 rad/sec of about 0.5–200 kilopoise.

14. The process of claim 13 wherein said first and second thermoplastic polymers each has a viscosity of about 2–80 kilopoise.

15. The process of claim 14 wherein said first and second thermoplastic polymers each has a viscosity of about 1.5–10 kilopoise.

16. The process of claim 1 further comprising:

combining said predispersion and said second thermoplastic polymer with a charge agent under conditions effective to form a yellow toner composition.

17. The process of claim 1 wherein said forming yellow toner particles from said yellow toner composition is carried out using a jet mill pulverizer.

18. The process of claim 1 wherein said yellow toner particles have a volume median particle size of about 4 microns to about 25 microns.

19. The process of claim 18 wherein said yellow toner particles have a volume median particle size of about 5 microns to about 12 microns.

20. The process of claim 19 wherein said yellow toner particles have a volume median particle size of about 6 microns to about 8 microns.

21. Yellow toner particles for the development of latent electrostatographic latent images, said particles being formed by the process of claim 1.

22. The yellow particles of claim 21 used together with magenta toner particles, cyan toner particles, and, optionally, black toner particles in a full color electrostatographic process.

23. The yellow particles of claim 22 used together with toners of other colors in pentachrome (five-color) or hexachrome (six-color) processes.

24. The yellow particles of claim 23 used together with orange-, green-, or purple-colored toners.

25. A process for obtaining enhanced covering power from a particulate yellow toner employed for the development of electrostatographic latent images, said process comprising:

combining dry Pigment Yellow 185 (P.Y.185) and a first thermoplastic polymer under conditions effective to form a predispersion of said P.Y.185 in said polymer;

combining said predispersion with a second thermoplastic polymer under conditions effective to form a yellow toner composition;

forming yellow toner particles from said yellow toner composition;

depositing a selected amount of said yellow toner particles on a selected area of a transparent substrate;

heating said particles on said substrate to a temperature sufficient to fuse said particles, thereby forming a continuous film of yellow toner; and determining the covering power of said continuous film of yellow toner, whereby said covering power is greater than the covering power of a continuous film obtained from said selected amount of yellow toner particles prepared from a flush concentrate of Pigment Yellow 185 and deposited on said selected area of a transparent substrate.

26. The process of claim 25 wherein each said combining is carried out using an extruder, a roll mill or a kneading mill at a temperature of about 80° C. to about 160° C.

27. The process of claim 25 wherein said first and second thermoplastic polymers are each polyesters.

28. The process of claim 27 wherein said first and second thermoplastic polymers are the same.

29. The process of claim 25 wherein said predispersion comprises about 20 to about 60 weight percent of said P.Y. 185 and about 80 to about 40 weight percent of said first thermoplastic polymer.

30. The process of claim 25 wherein said yellow toner composition comprises about 2 to about 30 weight percent of said P.Y. 185 and about 98 to about 70 weight percent of combined said first and second thermoplastic polymers.

31. The process of claim 25 wherein said first and second thermoplastic polymers each has a viscosity, measured at 120° C. at 1 rad/sec, of about 0.5–200 kilopoise.

32. The process of claim 25 further comprising:

combining said predispersion and said second thermoplastic polymer with a charge agent under conditions effective to form a yellow toner composition.

33. The process of claim 25 wherein said forming yellow toner particles from said yellow toner composition is carried out using a jet mill pulverizer.

34. The process of claim 25 wherein said yellow toner particles have a volume median particle size of about 2 microns to about 25 microns.

35. The process of claim 34 wherein said yellow toner particles have a volume median particle size of about 3 microns to about 5 microns.

* * * * *